United States Patent [19]

Golembeck et al.

[11] 4,112,529

[45] Sep. 12, 1978

[54] FOUNDATION UNIT FOR BEDDING

[75] Inventors: Gerald A. Golembeck, Lake Elmo; Thomas L. Horwitz, St. Paul, both of Minn.

[73] Assignee: The United States Bedding Company, St. Paul, Minn.

[21] Appl. No.: 807,968

[22] Filed: Jun. 20, 1977

[51] Int. Cl.[2] ..... A47C 23/00

[52] U.S. Cl. ..... 5/354; 5/351; 5/191; 5/267

[58] Field of Search ..... 5/190, 191, 267, 351, 5/354, 345 R

[56] References Cited

U.S. PATENT DOCUMENTS

| | | | |
|---|---|---|---|
| 3,602,926 | 9/1971 | Marini | 5/191 |
| 3,827,090 | 8/1974 | Roe | 5/351 |
| 3,981,034 | 9/1976 | MacMorran et al. | 5/354 |
| 3,992,732 | 11/1976 | Cervisi | 5/351 |

*Primary Examiner*—Casmir A. Nunberg
*Attorney, Agent, or Firm*—McDougall, Hersh & Scott

[57] ABSTRACT

A foam foundation unit for bedding in which a foam layer is supported on a wire grid that is fixed to the top side of the wooden base frame.

5 Claims, 3 Drawing Figures

FOUNDATION UNIT FOR BEDDING

This invention relates to a foundation unit for use with mattresses in the bedding field and relates more particularly to a foundation which makes use of a flexible foam mounted onto a supporting frame.

Foundations formed of a wooden frame with a covered panel for support of a foam layer have heretofore been produced, but such constructions are subject to a number of objectionable characteristics.

The supporting panel functions as a barrier on the underside of the foam layer which does not allow the foundation, and particularly the foam layer, to breathe, with corresponding discomfort in use, especially on hot and humid days.

The panel, usually formed of corrugated board or hardboard, provides an inadequate support in that it is incapable of distribution of load and often collapses in response to the concentration of load between supports.

A still further objection arises from the slippage of the foam layer on the supporting panel and a noise factor that arises between the foam and foundation material during use.

It is an object of this invention to produce a foam foundation which is simple in construction, which can be constructed of low cost and readily available materials, which is capable of carrying much heavier loads without destruction or deterioration, in which the noise factor is substantially if not completely eliminated, in which relative movement between the elements is prevented and which allows the foundation to breathe and, therefore, provide for increased comfort.

Figure 1:
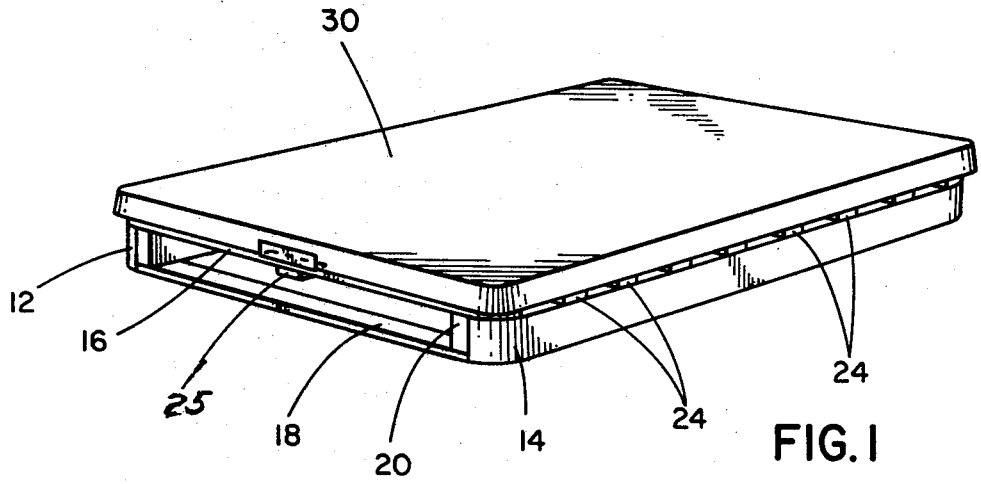
Figure 2:
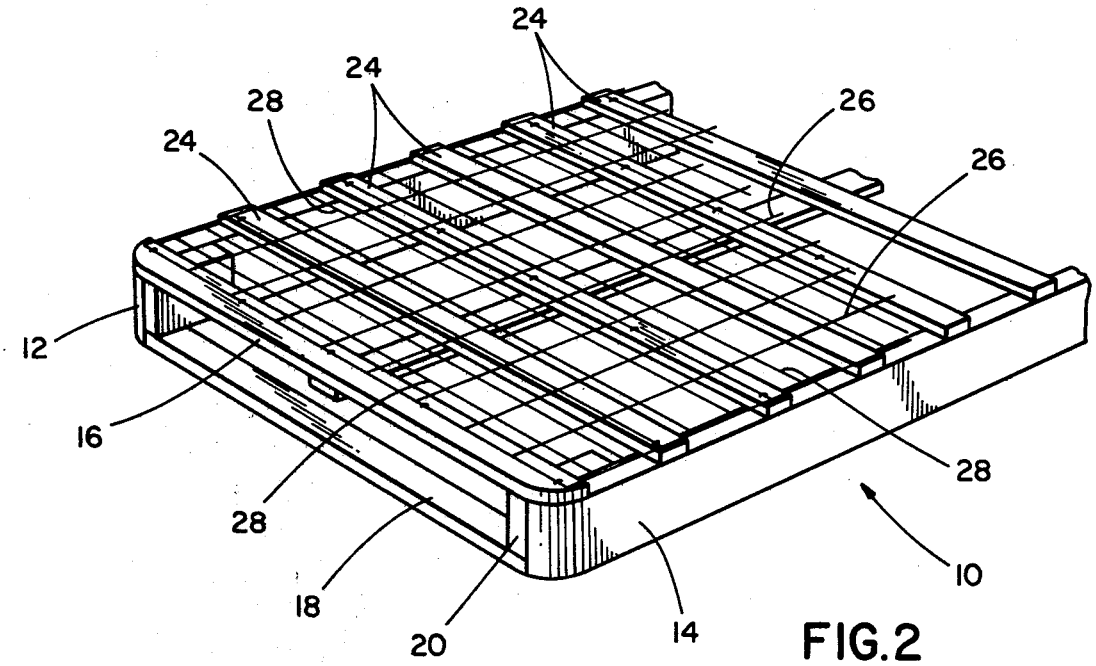
Figure 3:
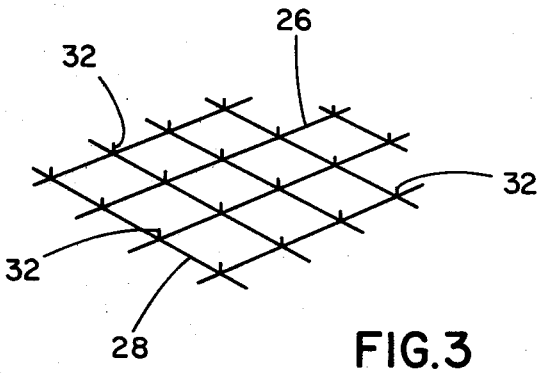

These and other objectives and advantages of this invention will hereafter appear, and for purposes of illustration but not of limitation, an embodiment of the invention is shown in the accompanying drawing in which:

FIG. 1 is a perspective view, in section, of a foundation embodying the features of this invention, FIG. 2 is a perspective view, in section, showing the grid in position of use on the wooden frame prior to application of the foam layer, and FIG. 3 is a fragmentary view of a modification in the wire grid.

Referring now to the drawing, the foundation of the invention makes use of a frame 10 of rectangular shape having a length and width corresponding to the size of the bed or mattress with which it is to be used. In the illustrated modification, the frame 10 is of a conventional construction formed of longitudinally extending side boards 12 and 14 spaced one from the other, in parallel relation, corresponding to the width of the frame. The side boards 12 and 14 are interconnected at their ends by transverse end boards 16 and 18 to provide a rectangular frame which is usually braced at the corners by corner blocks 20 with the spaced upper and lower transverse members secured to the corner blocks at each end. The wooden pieces are secured one to the other by conventional wood fastening means, such as screws, nails, adhesives or the like. Instead, the frame can be formed of metal or plastic. This would increase the weight and cost without the need for such additional strength.

A plurality of longitudinally spaced wooden slats 24 are arranged to extend crosswise of the upper edge of the side frame members 12 and 14 to which they are secured as by conventional fastening means of the type described. The slats 24 can be supported intermediate their ends by one or more boards 25 which extend lengthwise beneath the slats from end wall to end wall.

As illustrated in U.S. Pat. No 3,080,576, longitudinal members can be formed with an L-shaped cross section, with the L portion extending inwardly and spaced from the top side by an amount corresponding to the thickness of the cross extending slats 24 so that the top surfaces of the slats will be at the same level as the longitudinal and transverse frame members.

In accordance with the practice of this invention, a wire grid formed of a plurality of lengthwise and crosswise extending wires 26 and 28 respectively are anchored to the slafts 24 at their crossover points and they extend continuously to the side and end boards to which they are attached by brads, nails, or other suitable fastening means. In the present modification, the longitudinally and cross extending rows of wires are fixedly joined, as by soldering, welding or the like, at their crossover points to provide a unitary assembly which can be pre-assembled and in which the wires of the grid are better able to distribute load to adjacent portions of the grid in support of heavier loads.

The foam layer 30 can be positioned on top of the wire grid and then wholly enclosed in a suitable cover (not shown) to complete the foundation unit. The foam layer, which can be cut to size to fit onto the foundation, and which is usually of a thickness within the range of 1 to 6 inches, can be formed of flexible foam material, such as foam rubber, foam plastic, and the like, but it is preferred to make use of a foam layer 30 formed integrally of a polyurethane resin. The wire grid enables the foam layer freely to breathe while seating into the bottom side of the foam to militate against the generation of noise and/or slippage in use. Further, the resiliency of the grid enables the grid to flex under load and to distribute load to adjacent sections, whereby greater load can be accommodated without deterioration of the foundation.

The freedom of the release of air from the bottom side of the foam during compression is not inhibited by the grid wire support thereby to eliminate the boardy feel that characterizes the use of the standard solid platform. A further advantage is derived from the ability of the foam to deflect into the area between the grid wires. This allows additional compression of the foam layer with corresponding increase in the set of the bedding in use and with increased comfort.

When desired, the grid can be formed with means further to stabilize the foam layer onto the foundation. For this purpose, as illustrated in FIG. 3, the wire grid is formed, at its intersections with portions 32 which project upwardly in the form of fingers and which penetrate into the foam layer to militate against relative lateral or endwise movement. However, because of the slipping of the foam into the open area between the grid wires, such additional stabilizing means is not usually required.

Instead of making use of a grid formed of wires, such as spring wires, the grid may be formed of metal bands, or combinations of metal bands and wires, such as with bands forming the crosswise rows and wires forming the lengthwise rows.

It will be understood that changds may be made in the details of construction, arrangement and operation without departing from the spirit of the invention especially as defined in the following claims:

We claim:

1. A foam foundation unit for bedding comprising a base frame member formed of a pair of longitudinal side frame members and a pair of transverse end frame members joined one to the other to provide a base frame of rectangular shape, a plurality of longitudinally spaced apart slats extending crosswise between the longitudinal side frame members, a grid of spaced crosswise and lengthwise extending metal members, and means fixedly securing the grid directly to the slats and the base frame members at points where the grid crosses over the slats at base frame members, and a foam layer supported on the top side of the grid.

2. A foam foundation as claimed in claim 1, in which the metal members comprise wire.

3. A foam foundation as claimed in claim 1, in which the metal members comprise metal bands.

4. A foam foundation as claimed in claim 1, in which the foundation includes a cover enclosing the unit.

5. A foam foundation unit for bedding comprising a base frame member formed of a pair of longitudinal side frame members and a pair of transverse end frame members joined one to the other to provide a base frame of rectangular shape, a plurality of longitudinally spaced apart slats extending crosswise between the longitudinal side frame members, a grid of spaced crosswise and lengthwise extending metal members, and means securing the grid to the slats and the base frame members at crossover points, and a foam layer supported on the top side of the grid, which includes fingers projecting upwardly from the grid at the crossover points for penetration into the overlying foam layer, when in the assembled relation.

* * * * *